US011713636B2

(12) United States Patent
Mhaskar et al.

(10) Patent No.: US 11,713,636 B2
(45) Date of Patent: Aug. 1, 2023

(54) WELL PLUGS AND ASSOCIATED SYSTEMS AND METHODS

(71) Applicant: WEATHERFORD TECHNOLOGY HOLDINGS, LLC, Houston, TX (US)

(72) Inventors: Nauman H. Mhaskar, Houston, TX (US); James Rochen, Waller, TX (US); David B. Rougerie, Bordeaux (FR)

(73) Assignee: Weatherford Technology Holdings, LLC, Houston, TX (US)

( * ) Notice: Subject to any disclaimer, the term of this patent is extended or adjusted under 35 U.S.C. 154(b) by 52 days.

(21) Appl. No.: 15/841,651

(22) Filed: Dec. 14, 2017

(65) Prior Publication Data

US 2019/0186223 A1 Jun. 20, 2019

(51) Int. Cl.
*E21B 23/06* (2006.01)
*E21B 33/134* (2006.01)
*E21B 33/12* (2006.01)

(52) U.S. Cl.
CPC ..... *E21B 23/06* (2013.01); *E21B 33/12* (2013.01); *E21B 33/134* (2013.01)

(58) Field of Classification Search
CPC ..... E21B 23/06; E21B 33/12; E21B 33/134
See application file for complete search history.

(56) References Cited

U.S. PATENT DOCUMENTS 8,079,413 B2 * 12/2011 Frazier ..... E21B 33/12 166/124
8,496,052 B2 7/2013 Frazier
2003/0188860 A1 * 10/2003 Zimmerman ..... E21B 23/04 166/123
2007/0151722 A1 * 7/2007 Lehr ..... E21B 23/06 166/123
2010/0155050 A1 * 6/2010 Frazier ..... E21B 23/06 166/123
2011/0240295 A1 * 10/2011 Porter ..... E21B 33/134 166/308.1
2012/0006532 A1 * 1/2012 Frazier ..... E21B 34/14 166/196

(Continued)

OTHER PUBLICATIONS

Weatherford; "Shorty Composite Frac Plug", company article No. 12746.00, dated 2017, 1 page.

(Continued)

*Primary Examiner* — Tara Schimpf
*Assistant Examiner* — Neel Girish Patel
(74) *Attorney, Agent, or Firm* — Smith IP Services, PC

(57) ABSTRACT

A well plug for use in a subterranean well can include a generally tubular mandrel, a seal element positioned on the mandrel, and a setting rod releasably secured relative to the mandrel by an annular shaped shear ring or a bonded sleeve. The setting rod is releasable for longitudinal displacement relative to the mandrel in response to a predetermined shear force applied to the shear ring or bonded sleeve. A method of setting a well plug in a subterranean well can include displacing a generally tubular mandrel with a setting rod relative to an outer housing of the well plug, outwardly extending a seal element of the well plug in response to the displacing, and shearing a releasable attachment securing the setting rod relative to the mandrel, the releasable attachment comprising an annular shaped shear ring, or a bond between a sleeve and a surface.

13 Claims, 9 Drawing Sheets

(56) References Cited

U.S. PATENT DOCUMENTS

| | | | | |
|---|---|---|---|---|
| 2013/0240200 | A1* | 9/2013 | Frazier | E21B 33/129 166/135 |
| 2015/0260008 | A1* | 9/2015 | McCoy | E21B 33/134 166/138 |
| 2017/0022781 | A1* | 1/2017 | Martin | E21B 33/1208 |
| 2018/0266205 | A1* | 9/2018 | Martin | E21B 33/1277 |
| 2019/0264513 | A1* | 8/2019 | Kosel | E21B 33/128 |
| 2022/0186593 | A1* | 6/2022 | Wetzel | E21B 17/028 |
| 2022/0195835 | A1* | 6/2022 | Acosta Villarreal | E21B 34/063 |

OTHER PUBLICATIONS

Weatherford; "TruFac Composite Frac Plug", company article No. 11364.02, dated 2015, 4 pages.

Argentina Office Action dated Jun. 15, 2022 for AR Patent No. P180103669, 5 pages.

English Translations of Argentina Office Action dated Jun. 15, 2022 for AR Patent No. P180103669, 2 page.

* cited by examiner

WELL PLUGS AND ASSOCIATED SYSTEMS AND METHODS

BACKGROUND

This disclosure relates generally to equipment utilized and operations performed in conjunction with a subterranean well and, in an example described below, more particularly provides an economical well plug with consistent setting.

A well plug (such as, a "frac" plug, a bridge plug, etc.) can be used to isolate one section of a wellbore from another section of the wellbore. A well plug can be set in a tubular string, in which case the plug can isolate sections of the tubular string from each other.

It will, thus, be readily appreciated that improvements are continually needed in the arts of designing, constructing and utilizing well plugs. Such improvements could be incorporated into a variety of different types of well plugs, and could be used in a variety of different well operations.

DETAILED DESCRIPTION

Figure 1:
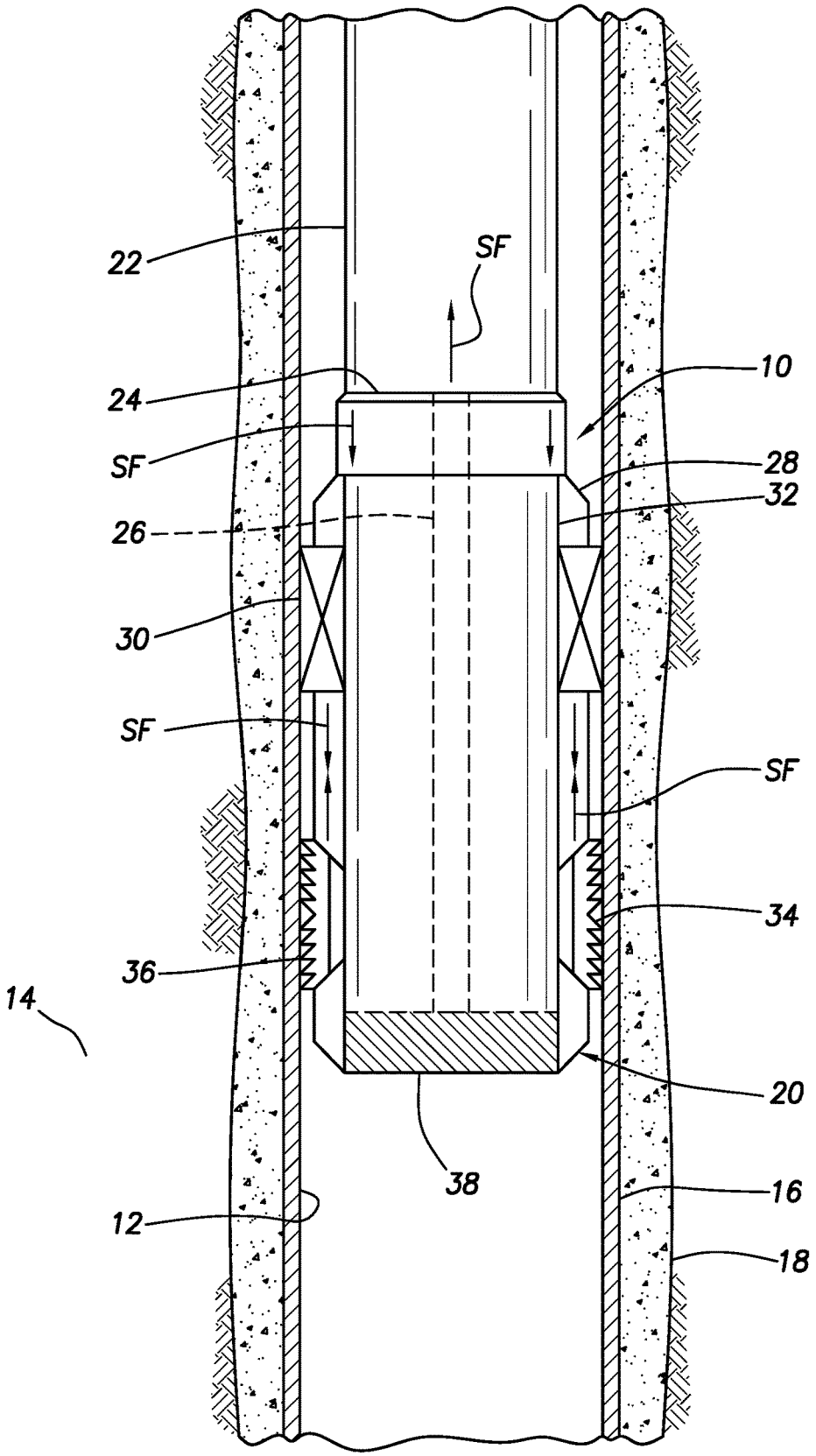
FIG. 1 is a representative partially cross-sectional view of an example of a well system and associated method which can embody principles of this disclosure.

Representatively illustrated in FIG. 1 is a system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 penetrates an earth formation 14. The wellbore 12 is generally vertical and is lined with casing 16 and cement 18. In other examples, the wellbore 12 could be horizontal or otherwise deviated relative to vertical, and the principles of this disclosure may be practiced in an uncased or open hole section of the wellbore.

In order to isolate upper and lower sections of the wellbore 12 from each other, a well plug 20 is conveyed into the wellbore with a setting tool 22. The well plug 20 and setting tool 22 may be conveyed by wireline, coiled tubing, or another type of conveyance.

The setting tool 22 is operatively connected to the well plug 20 with a setting tool adapter 24. In other examples, the setting tool adapter 24 may not be used (e.g., if the setting tool 22 and well plug 20 are configured for direct connection to each other).

As depicted in FIG. 1, the setting tool 22, when actuated, produces opposing longitudinal setting forces SF. A tensile setting force SF is applied upwardly to a setting rod 26 extending through the well plug 20. An oppositely directed compressive setting force SF is applied to an outer housing 28 of the well plug 20. As a result, the setting force SF is applied as a longitudinally compressive force to the well plug 20.

The setting force SF may be applied by the setting tool 22 in any of a variety of different ways, including ignition of a propellant, hydraulic, electrical or mechanical actuation, etc.). Thus, the scope of this disclosure is not limited to use of any particular type of setting tool to apply the setting force SF to the well plug 20.

A seal element 30 is positioned on an inner generally tubular mandrel 32 of the well plug 20 in the FIG. 1 example. Application of the setting force SF to the seal element 30 causes it to extend radially outward into sealing contact with the casing 16. If the wellbore 12 is uncased, the seal element 30 could sealingly engage an inner wall of the formation 14.

In some examples, the seal element 30 could comprise an annular elastomeric material that extends radially outward in response to longitudinal compression. In other examples, other materials (such as, non-elastomers, plastics, composites, ceramics, metals, etc.) may be used.

In further examples, the seal element 30 could extend into sealing engagement with a surrounding well surface in response to the setting force SF, without the seal element itself being longitudinally compressed (e.g., the seal element could be radially displaced without being longitudinally compressed). Thus, the scope of this disclosure is not limited to any particular type of seal element or setting mechanism used with the well plug 20.

The FIG. 1 well plug 20 includes an anchor 34 for securing the well plug 20 against longitudinal displacement relative to the wellbore 12. In this example, the well plug 20 includes slips 36 that grip an interior surface of the wellbore 12 (in this case, an interior surface of the casing 16).

The slips 36 extend radially outward into gripping engagement with the casing 16 in response to application of the compressive setting force SF to the well plug 20. In the FIG. 1 example, the slips 36 include multiple individual slip members, but in other examples a single barrel slip, longitudinally spaced apart gripping members, or other types of gripping members could be used. Thus, the scope of this disclosure is not limited to any particular configuration or structure of the anchor 34 used with the well plug 20.

In the FIG. 1 example, the setting rod 26 is connected to the well plug 20 with a releasable attachment 38. The releasable attachment 38 releases the setting rod 26 from the well plug 20, so that the setting tool 22, the setting rod 26 and optionally the setting adapter 24 can be retrieved from the wellbore 12 after the well tool 20 has been set.

The releasable attachment 38 initially secures the setting rod 26 to the well plug 20, thereby enabling the force SF produced by the setting tool 22 to be transmitted as a compressive force to the well plug, in order to set the well plug. The force SF produced by the setting tool 22 eventually reaches a predetermined level at which the well plug 20 has been set, with the seal element 30 sealingly engaging the wellbore 12 and the anchor 34 grippingly engaging the wellbore.

When the predetermined level is reached, the releasable attachment 38 releases, and the setting tool 22, the setting rod 26 and optionally the setting adapter 24 can be retrieved from the wellbore 12. As described more fully below with regard to certain examples of the well plug 20, the releasable attachment 38 is designed so that it will release at a consistent predetermined setting force SF level (thereby ensuring that the well plug 20 is fully set when the release occurs), no or minimal debris is left in the well due to the release (thereby minimizing the possibility of delaying or fouling subsequent operations and equipment in the wellbore 12), and the releasable attachment is compact and economical to incorporate into the well plug assembly.

Referring additionally now to FIGS. 2A-D, more detailed cross-sectional views of an example of the well plug 20 in various stages of a setting operation are representatively illustrated. For convenience, the FIGS. 2A-D well plug 20 is described below as it may be used in the system 10 and method of FIG. 1, but it should be understood that the well plug may be used in other systems and methods, in keeping with the principles of this disclosure.

The setting tool 22 and setting tool adapter 24 are not shown in FIGS. 2A-D for clarity. The setting rod 26 shown in FIGS. 2A-D may, however, be a part of the setting tool 22, the setting tool adapter 24, or another tool used to apply the setting force SF to the well plug 20.

Note that the anchor 34 in the FIGS. 2A-D example comprises two barrel slips 36 longitudinally spaced apart on the mandrel 32, with corresponding conical wedges 40 for outwardly deflecting the slips. The wedges 40 are also positioned straddling the seal element 30, so that the seal element will be longitudinally compressed between the wedges when the setting force SF is applied.

Figure 2A:
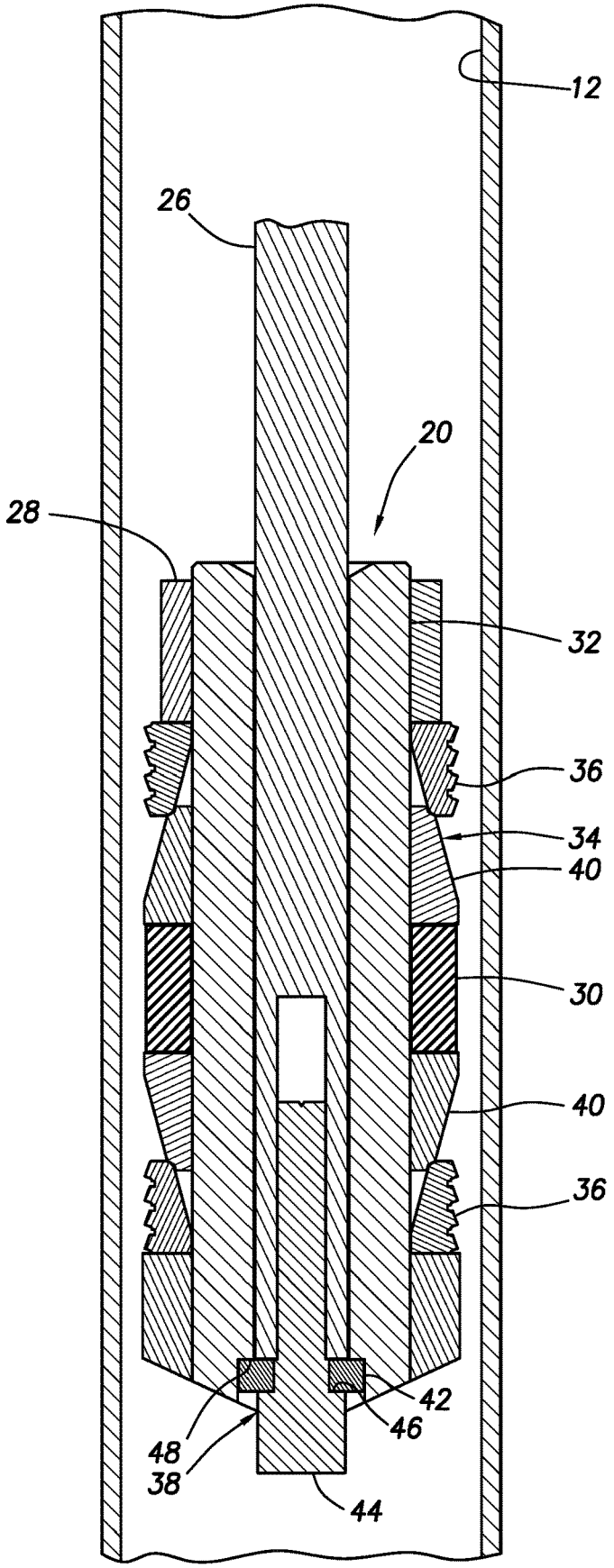
FIGS. 2A-D are representative cross-sectional views of steps in a method of setting an example of a well plug embodying the principles of this disclosure.

As depicted in FIG. 2A, the well plug 20 is in a run-in configuration. In this configuration, the well plug 20 can be conveyed to a desired location for setting in the wellbore 12.

The seal element 30 and the anchor 34 are radially inwardly retracted. The setting rod 26 is releasably secured to the well plug 20 with the releasable attachment 38.

In this example, the releasable attachment 38 includes an annular-shaped shear ring 42 secured to an end of the setting rod 26 with a fastener 44 (in this case, a threaded bolt or screw). The shear ring 42 and the fastener 44, thus, are constrained to displace with the setting rod 26.

The shear ring 42 is "annular" in shape, in that it is generally ring-shaped. In some examples, the shear ring 42 may not extend completely circumferentially about the fastener 44 (e.g., the shear ring could extend less than a full 360 degrees about the fastener). In other examples, the shear ring 42 may not be strictly circular in shape (e.g., the shear ring could have a non-circular shape, such as, oval, oblong, etc.).

The shear ring 42 is positioned longitudinally between an annular shoulder 46 formed on the fastener 44 and an oppositely facing annular shoulder 48 formed on the setting rod 26. When the setting force SF is applied to the setting rod 26, it is transmitted in shear through the shear ring 42 to the mandrel 32.

Figure 2B:
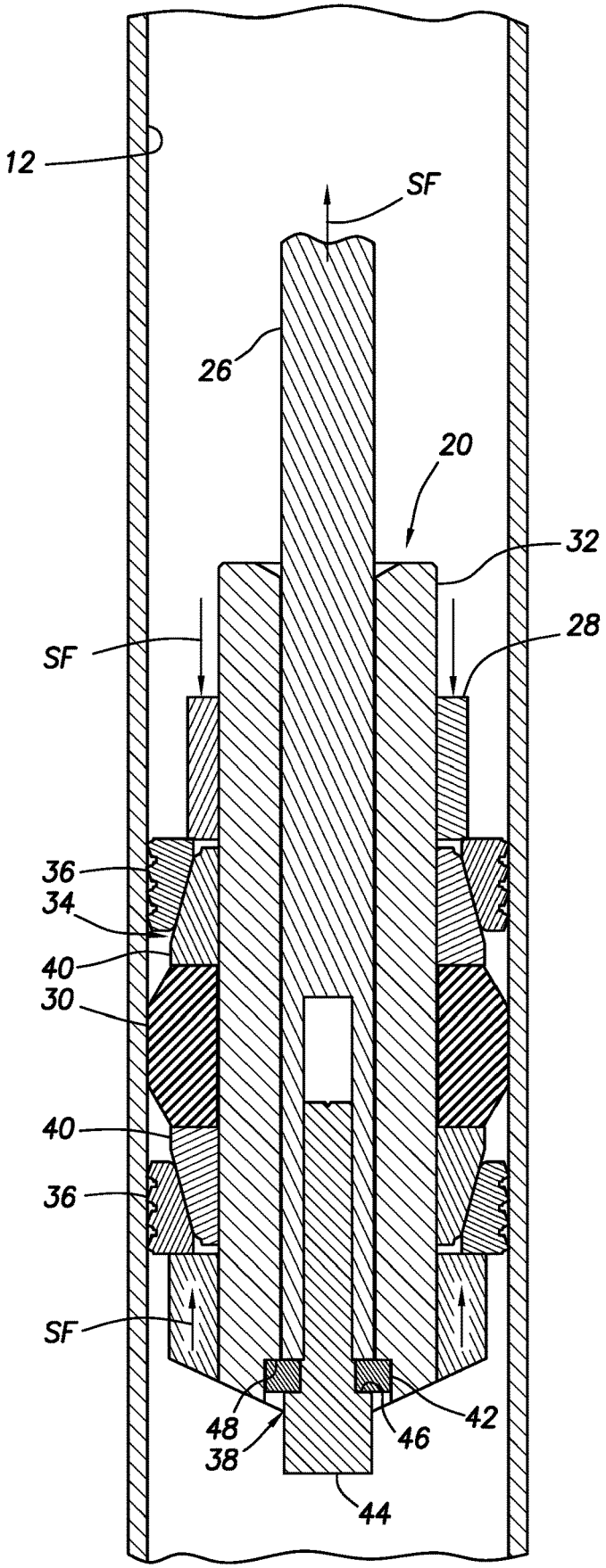

In FIG. 2B, the well plug 20 is depicted in a configuration in which the setting operation has been initiated, with the setting force SF being applied via the setting rod 26 to the well plug. The seal element 30 is longitudinally compressed by the setting force SF, causing it to extend radially outward into sealing engagement with the wellbore 12.

The slips 36 are displaced radially outward by the wedges 40 into gripping engagement with the wellbore 12. The releasable attachment 38 still releasably secures the setting rod 26 to the well plug 20, so the setting force SF continues to be applied to the well plug. The setting force SF is experienced as a shear force in the shear ring 42 between the annular shoulders 46, 48.

Figure 2C:
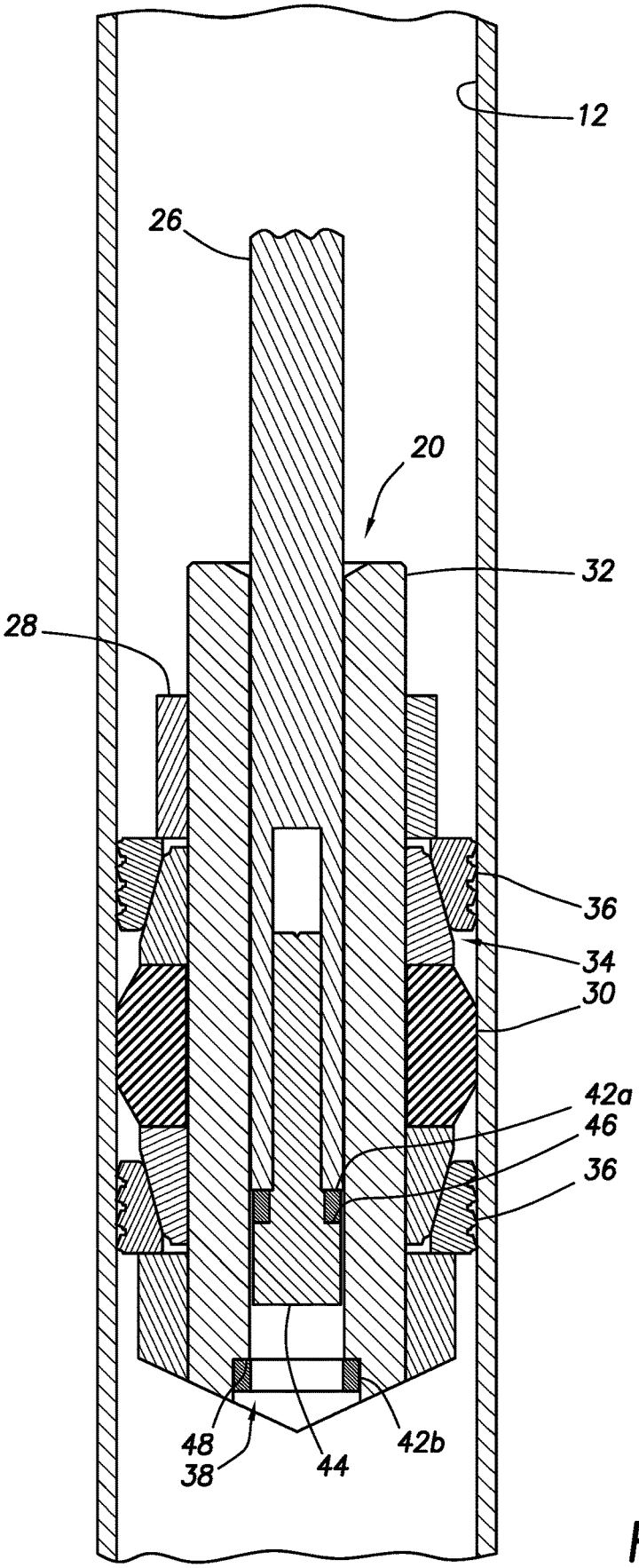

In FIG. 2C, the setting force SF has reached the predetermined level, thereby causing the shear ring 42 to shear into two sections 42*a,b*. In this manner, the setting rod 26 is released from the well plug 20 for retrieval from the wellbore 12.

In this example, the shear ring 42 comprises a material that provides a consistent shearing at the predetermined level of the setting force SF. The material can include, but is not limited to, fiber reinforced composite, plastic, phenolic, ceramic (e.g., zirconia, silicon nitride, alumina, cermet, etc.), ductile iron, alloy steel, non-ferrous alloys (e.g., brass, aluminum alloys, copper alloys, etc.), or materials dissolvable in a well environment (such as, magnesium alloys, aluminum alloys, poly-glycolic acid (PGA), poly-lactic acid (PLA), fiber reinforced PGA or PLA, etc.). In one example, a National Electrical Manufacturers Association (NEMA) G-11 laminate material (comprising a woven glass fabric and high temperature rated epoxy resin composite) marketed by Norplex-Micarta of Postville, Iowa USA may be used for the shear ring 42.

Figure 2D:
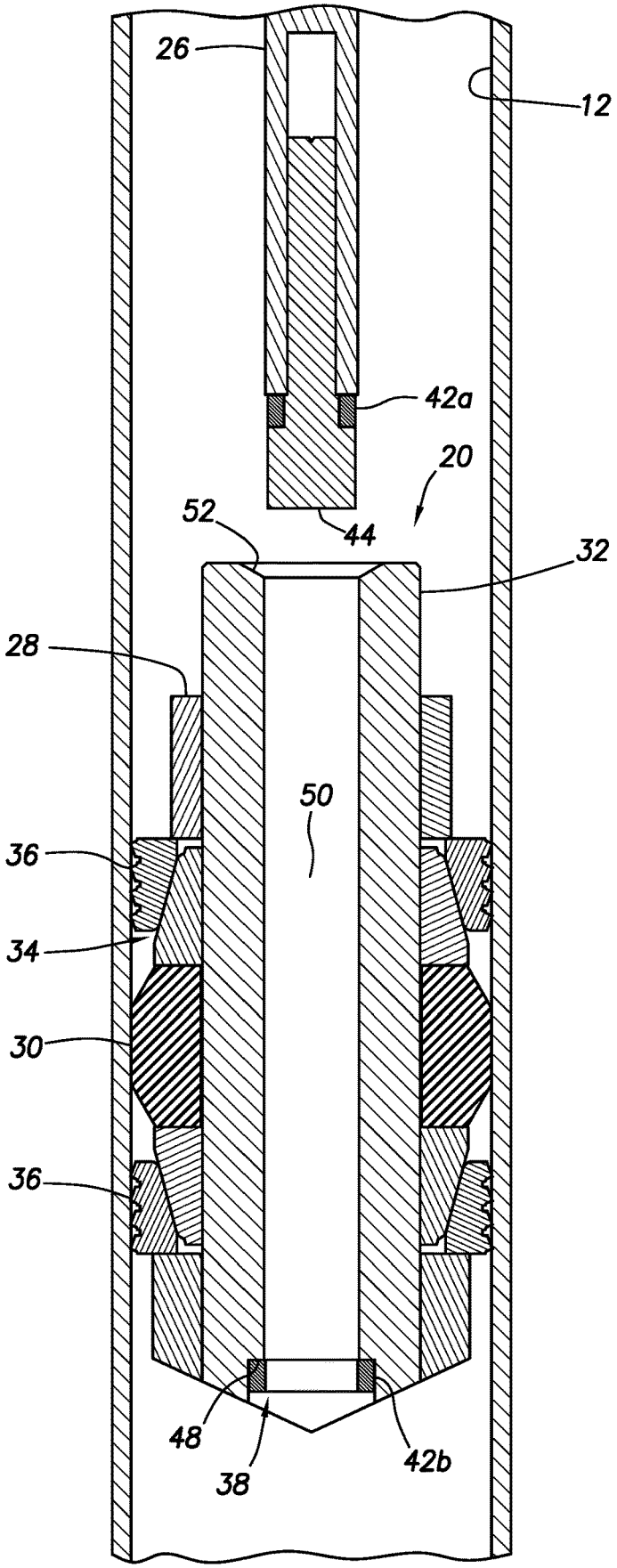

In FIG. 2D, the setting rod 26 is retrieved from the well, while the well plug 20 remains set in the wellbore 12. Note that one section of the shear ring 42*a* is retrieved from the well with the setting rod 26 (retained by the fastener 44), and the other section of the shear ring 42*b* remains with the well plug 20 (for example, the shear ring section 42*b* could be press-fit, bonded, fastened or otherwise attached to the mandrel 32). Thus, neither of the shear ring sections 42*a,b* becomes loose debris in the wellbore 12.

A flow passage 50 may extend longitudinally through the well plug 20, after the shear ring 42 has been sheared and the setting rod 26 has been withdrawn from the well plug. When it is desired to prevent flow through the flow passage 50, a plug device (such as, a ball, dart or other device, not shown, capable of blocking the flow passage 50) may be installed in the wellbore 12 to sealingly engage a seal surface or seat 52 formed at an upper end of the mandrel 32. For example, in a fracturing or other stimulation operation, the sealed off flow passage 50 may prevent fracturing fluid pumped to a formation zone above the well plug 20 from being communicated to a previously fractured zone below the well plug.

Eventually, the isolation between zones provided by the well plug 20 may no longer be desired. In that case, the well plug 20 can be milled or drilled through, and for this purpose can comprise relatively easily milled or drilled materials. For example, some or all structural components of the well plug 20 (such as, the mandrel 32, wedges 40 and outer housing 28) could be made of a filament wound and two-part epoxy composite material, or an aluminum alloy.

In some examples, the well plug may degrade in the wellbore 12 (e.g., by dissolving, dispersing, corroding, hydrating, etc.). If the well plug 20 degrades in the wellbore 12, it may do so autonomously (such as, in response to passage of a predetermined period of time), without human intervention (such as, in response to exposure to downhole temperature or environment), or in response to an applied stimulus (such as, in response to spotting an acid or other degrading substance in the wellbore at the well plug).

A magnesium alloy could be readily dissolved by spotting an acid at the well plug 20. A PGA or PLA material can be dissolved by hydration. An aluminum alloy can disperse by galvanic reaction. The scope of this disclosure is not limited to use of any particular material or combination of materials in the well plug 20. In addition, it is not necessary for the well plug 20 to be drilled, milled, dissolved, dispersed or otherwise removed from its sealing and gripping engagement with the wellbore 12 as depicted in FIG. 2D.

Referring additionally now to FIGS. 3A-D, cross-sectional views of another example of the well plug 20 in various stages of a setting operation are representatively illustrated. For convenience, the FIGS. 3A-D well plug 20 is described below as it may be used in the system 10 and method of FIG. 1, but it should be understood that the well plug may be used in other systems and methods, in keeping with the principles of this disclosure.

The FIGS. 3A-D well plug 20 example is similar in many respects to the FIGS. 2A-D example, but the releasable attachment 38 in the FIGS. 3A-D example does not include the shear ring 42 for releasably attaching the setting rod 26 to the mandrel 32. Instead, the FIGS. 3A-D example includes a sleeve 54 that abuts the annular shoulder 48 in the mandrel 32 and is thereby capable of transmitting the setting force SF from the setting rod 26 to the mandrel.

The sleeve 54 may be made of a material that is relatively easily drillable or millable, or that is self-degradable or otherwise degradable in the well. Suitable materials for use in the sleeve 54 can include fiber reinforced composite, plastic, phenolic, ceramic (e.g., zirconia, silicon nitride, alumina, cermet), ductile iron, alloy steel, non-ferrous alloys (e.g., brass, aluminum alloys, copper alloys, etc.), and dissolvable materials (e.g., magnesium alloys, aluminum alloys, PGA, PLA, fiber reinforced PGA or PLA, etc.).

Figure 3A:
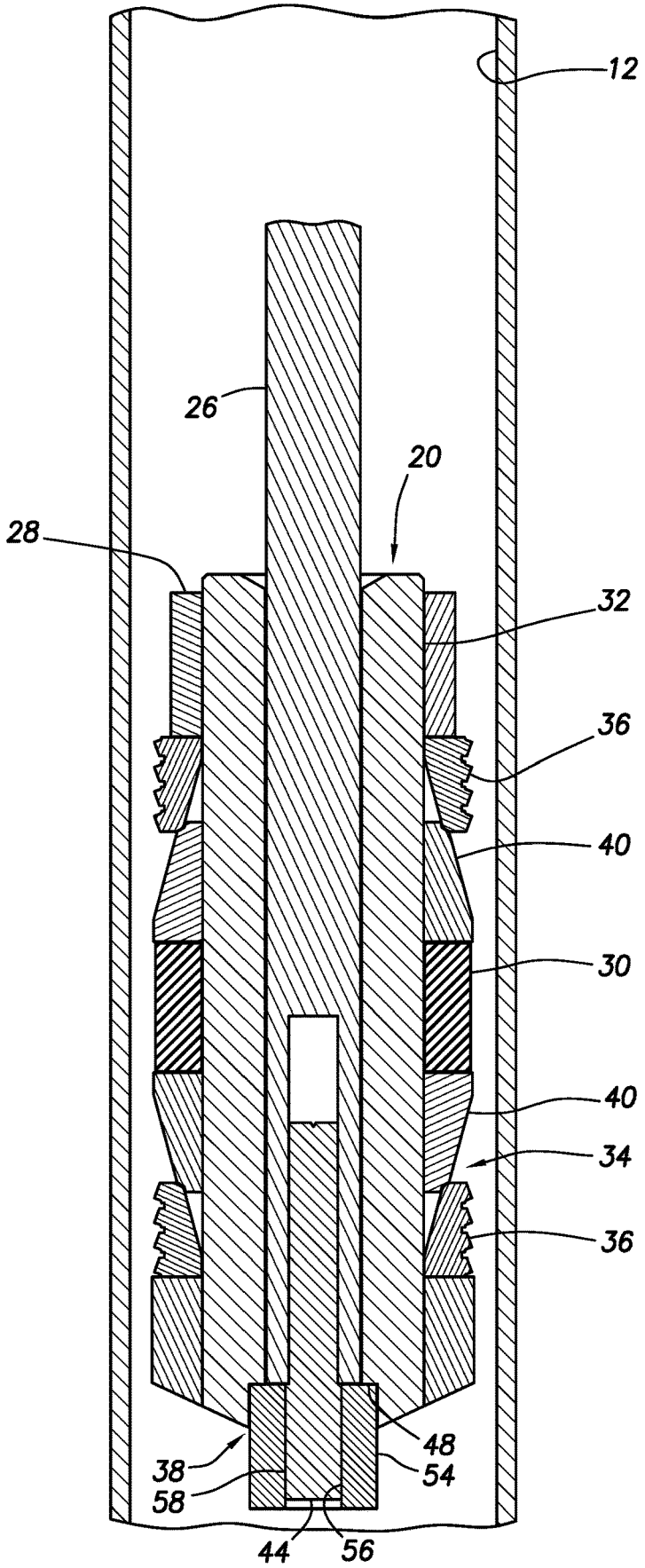
FIGS. 3A-D are representative cross-sectional views of steps in a method of setting another example of the well plug.

The sleeve 54 is initially releasably secured to the setting rod 26 with a bond 56 between the sleeve and a surface 58 on or connected to the setting rod, as depicted in the run-in configuration of FIG. 3A. In this example, the surface 58 is cylindrical and is formed on the fastener 44, but in other examples the surface could be formed on the setting rod 26 or other structure.

An adhesive, thermoplastic or other material may be used for forming the bond 56 between the sleeve and the surface 58. Preferably, the bond 56 has a consistent shear strength, so that the setting rod 26 is reliably released from the well plug 20 after it is set in the wellbore 12, as described more fully below. Suitable materials for forming the bond 56 can include one or two part epoxies and cyanoacrylate adhesives, although other materials may be used in keeping with the scope of this disclosure.

Figure 3B:
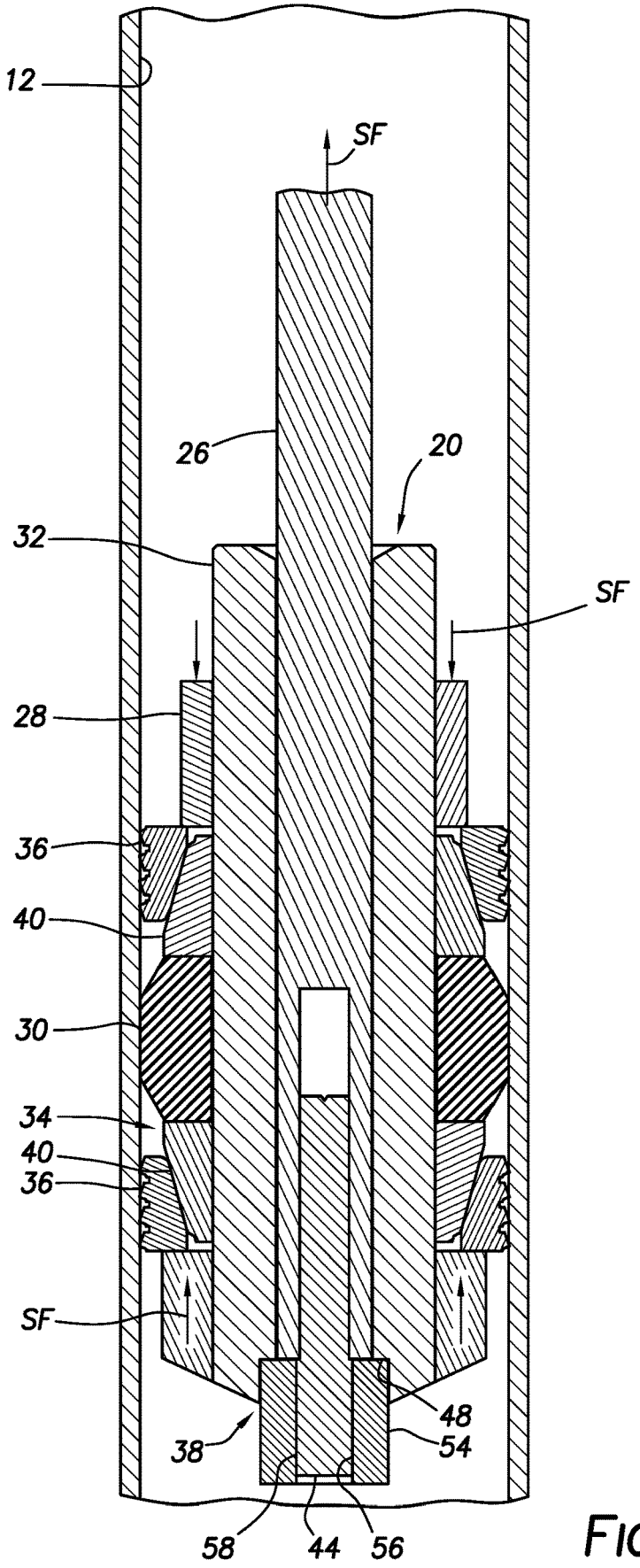

In FIG. 3B, the setting force SF is applied from the setting tool 22 (see FIG. 1) to the well plug 20 via the setting rod 26. The bond 56 between the surface 58 and the sleeve 54 permits the setting force SF to be transmitted from the setting rod 26 to the mandrel 32, so that the seal element 30 and slips 36 extend radially outward into sealing and gripping engagement with the wellbore 12. The setting force SF is applied as a shear force in the bond 56.

Figure 3C:
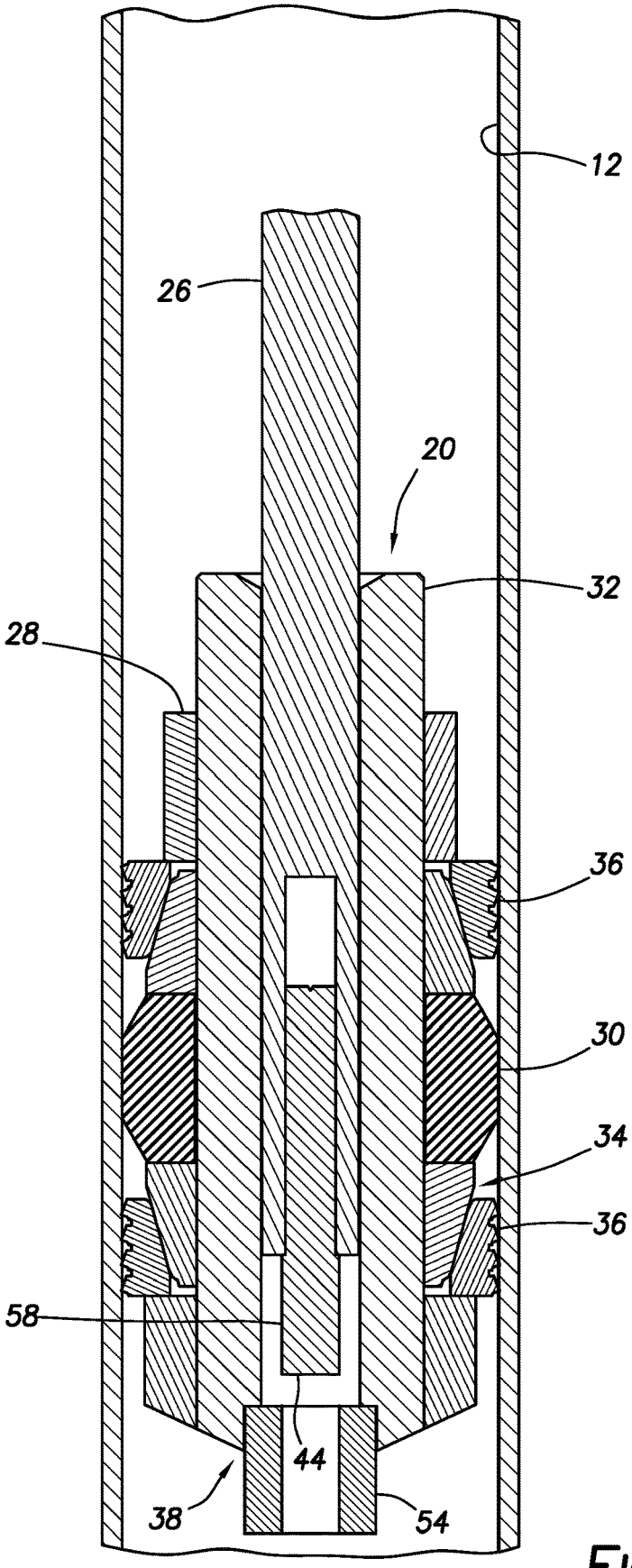

In FIG. 3C, the bond 56 between the sleeve 54 and the surface 58 is sheared when the setting force SF reaches the predetermined level. At this point, the well plug 20 is set in the wellbore 12 and the setting rod 26 is released from the well plug for retrieval. The sleeve 54 may be press-fit bonded, fastened or otherwise attached to the mandrel 32, so that it does not become loose debris in the wellbore 12 after the bond 56 is sheared.

Figure 3D:
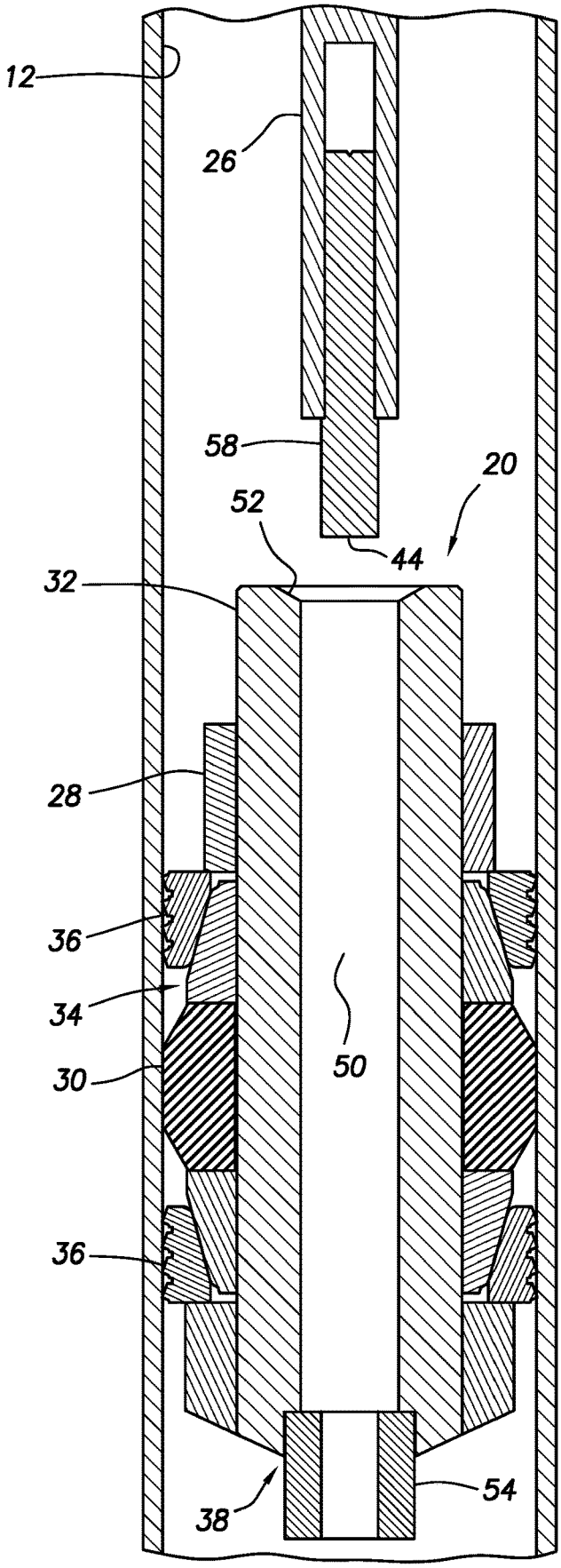

In FIG. 3D, the setting rod 26 is withdrawn from the well plug 20. As described above for the FIGS. 2A-D example, a ball, dart or other plug device (not shown) may subsequently engage the seat 52 to seal off the flow passage 50. The well plug 20 may eventually be drilled or milled through, dissolved, dispersed or degraded downhole, or otherwise removed from its sealing and gripping engagement in the wellbore 12.

It may now be fully appreciated that the above disclosure provides significant advancement to the arts of designing, constructing and utilizing well plugs. In examples described above, the releasable attachment 38 allows the setting rod 26 to be conveniently and economically attached to the well plug 20, while also providing for consistent release at a predetermined setting force SF level, and minimizing debris left behind in the wellbore 12.

A well plug 20 for use in a subterranean well is provided to the art by the above disclosure. In one example, the well plug 20 can include a generally tubular mandrel 32, a seal element 30 positioned on the mandrel 32, and a setting rod 26 releasably secured relative to the mandrel 32 by an annular shaped shear ring 42. The setting rod 26 is releasable for longitudinal displacement relative to the mandrel 32 in response to a predetermined shear force SF applied to the shear ring 42.

The shear ring 42 may be positioned longitudinally between a first annular shoulder 46 that displaces with the setting rod 26, and a second annular shoulder 48 that displaces with the mandrel 32. The first annular shoulder 46 may be formed on a fastener 44 that secures the shear ring 42 to the setting rod 26. The second annular shoulder 48 may be formed in the mandrel 32.

The seal element 30 may be positioned between first and second structures (such as, the wedges 40), and the seal element 30 may be outwardly extendable in response to a decrease in a longitudinal distance between the first and second structures 40. The first structure 40 may displace with the mandrel 32.

The predetermined shear force SF may be transmitted from the setting rod 26 to the mandrel 32 via the shear ring 42.

Another example of a well plug 20 is provided to the art by the above disclosure. In this example, the well tool 20 can include a generally tubular mandrel 32, a seal element 30 positioned on the mandrel 32, and a setting rod 26 releasably secured relative to the mandrel 32 by a sleeve 54 bonded to a surface 58, the setting rod 26 being releasable for longitudinal displacement relative to the mandrel 32 in response to a predetermined shear force applied to the sleeve 54.

The surface 58 may be formed on a structure (such as, the fastener 44) that displaces with the setting rod 26.

The sleeve 58 may engage an annular shoulder 48 formed on the mandrel 32.

The sleeve 58 may be bonded to the surface 58 by an adhesive.

The predetermined shear force SF may be transmitted from the setting rod 26 to the mandrel 32 via the sleeve 54.

A method of setting a well plug 20 in a subterranean well is also provided to the art by the above specification. In one example, the method can comprise: displacing a generally tubular mandrel 32 with a setting rod 26 relative to an outer housing 28 of the well plug 20; outwardly extending a seal element 30 of the well plug 20 in response to the displacing; and shearing a releasable attachment 38 securing the setting rod 26 relative to the mandrel 32, the releasable attachment 38 comprising one of the group consisting of: a) an annular shaped shear ring 42 and b) a bond 56 between a sleeve 54 and a surface 58.

The shearing step may include shearing the shear ring 42 between annular shaped shoulders 46, 48. The shearing step may further include releasing the setting rod 26 for displacement relative to the mandrel 32 in response to a predetermined shear force SF being applied to the shear ring 42. One of the annular shoulders 46 may displace with the setting rod 26, and another annular shoulder 48 may displace with the mandrel 32.

The shearing step may include displacing the surface 58 with the setting rod 26 relative to the mandrel 32. The sleeve 54 may abut an annular shoulder 48 formed in the mandrel 32.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well plug for use in a subterranean well, the well plug comprising:

a tubular mandrel;

a seal element positioned on the tubular mandrel; and a setting rod releasably secured relative to the tubular mandrel by an annular shaped shear ring having longitudinally-extending straight parallel sides within which the shear ring is configured to shear, in which an uppermost surface of the shear ring abuts a lowermost surface of the setting rod in an assembled configuration of the well plug, and in which the setting rod is configured to apply a compressive force to the tubular mandrel during setting of the well plug, the setting rod being releasable for longitudinal displacement relative to the tubular mandrel in response to a predetermined shear force applied to the shear ring.

2. The well plug of claim 1, in which the shear ring is positioned longitudinally between a first annular shoulder that displaces with the setting rod, and a second annular shoulder that displaces with the tubular mandrel.

3. The well plug of claim 2, in which the first annular shoulder is formed on a fastener that secures the shear ring to the setting rod.

4. The well plug of claim 2, in which the second annular shoulder is formed in the tubular mandrel.

5. The well plug of claim 1, in which the seal element is positioned between first and second structures, the seal element being outwardly extendable in response to a decrease in a longitudinal distance between the first and second structures.

6. The well plug of claim 5, in which the first structure displaces with the tubular mandrel.

7. The well plug of claim 1, in which the predetermined shear force is transmitted from the setting rod to the tubular mandrel via the shear ring.

8. The well plug of claim 1, in which the shear ring is received in a counterbore in a lowermost end of the tubular mandrel.

9. A method of setting a well plug in a subterranean well, the method comprising:

displacing a tubular mandrel with a setting rod relative to an outer housing of the well plug, in which a compressive force is applied to the tubular mandrel by the setting rod during the displacing;

outwardly extending a seal element of the well plug in response to the displacing; and shearing a releasable attachment securing the setting rod relative to the tubular mandrel, the releasable attachment comprising an annular shaped shear ring having longitudinally-extending straight parallel sides within which the shear ring is configured to shear, in which an uppermost surface of the shear ring abuts a lowermost surface of the setting rod, and in which the releasable attachment is positioned proximate a lowermost end of the tubular mandrel.

10. The method of claim 9, in which the shearing comprises shearing the shear ring between annular shaped shoulders.

11. The method of claim 10, in which the shearing further comprises releasing the setting rod for displacement relative to the tubular mandrel in response to a predetermined shear force being applied to the shear ring.

12. The method of claim 10, in which one of the annular shoulders displaces with the setting rod, and another annular shoulder displaces with the tubular mandrel.

13. The method of claim 9, in which the releasable attachment is received in a counterbore in the lowermost end of the tubular mandrel.

* * * * *